US007077278B2

(12) United States Patent
Dubach

(10) Patent No.: US 7,077,278 B2
(45) Date of Patent: Jul. 18, 2006

(54) SCREW CAP COMPRISING A TAMPER-EVIDENT BAND

(75) Inventor: Werner Fritz Dubach, Maur (CH)

(73) Assignee: Bericap Holding GmbH, Budenheim (DE)

( * ) Notice: Subject to any disclaimer, the term of this patent is extended or adjusted under 35 U.S.C. 154(b) by 22 days.

(21) Appl. No.: 10/481,169

(22) PCT Filed: May 24, 2002

(86) PCT No.: PCT/CH02/00277

§ 371 (c)(1),
(2), (4) Date: Dec. 18, 2003

(87) PCT Pub. No.: WO02/102678

PCT Pub. Date: Dec. 27, 2002

(65) Prior Publication Data

US 2004/0206720 A1 Oct. 21, 2004

(30) Foreign Application Priority Data

Jun. 18, 2001 (CH) ..... 1104/01

(51) Int. Cl.
*B65D 39/00* (2006.01)

(52) U.S. Cl. ..... 215/252; 215/257

(58) Field of Classification Search ..... 215/252, 215/257, 258, 901
See application file for complete search history.

(56) References Cited

U.S. PATENT DOCUMENTS

| | | | | |
|---|---|---|---|---|
| 3,463,341 | A * | 8/1969 | Fields | 215/252 |
| 4,458,820 | A * | 7/1984 | Abrams | 215/230 |
| 4,936,475 | A * | 6/1990 | Montgomery | 215/252 |
| 6,116,443 | A | 9/2000 | Parrinello | |

FOREIGN PATENT DOCUMENTS

| | | |
|---|---|---|
| DE | 31 00 629 A1 | 1/1982 |
| DE | 31 11 692 A1 | 1/1982 |
| EP | 0 149 496 B1 | 1/1990 |
| EP | 0 460 557 B1 | 10/1993 |
| EP | 0 593 396 A1 | 4/1994 |
| EP | 0 625 950 B1 | 3/1997 |
| GB | 2 159 123 A | 11/1985 |

* cited by examiner

*Primary Examiner*—Lien M. Ngo
(74) *Attorney, Agent, or Firm*—Pauley Petersen & Erickson

(57) ABSTRACT

At least one cutting element on a closure having a spout and a screw cap, which can be screwed thereon and which has a tamper-evident band. The tamper-evident band is joined to a lower edge of an outer wall of the screw cap via specified rupture location bridges. The at least one cutting element outwardly projects through an intermediate space. When the screw cap is unscrewed for the first time, the at least one cutting element cuts through the specified rupture location bridges. A distance between the tamper-evident band upper edge and the lower edge of the screw cap is provided with a measure whereby enabling the distance to be surmounted only occurs once all specified rupture location bridges are cut through.

10 Claims, 3 Drawing Sheets

SCREW CAP COMPRISING A TAMPER-EVIDENT BAND

BACKGROUND OF THE INVENTION

1. Field of the Invention

This invention relates to a receptacle with a closure, having a screw cap with an inner thread and with a guarantee strip without a tear-open tab, which is fastened to the screw cap and is connected via break-off bridge locations, and the receptacle has a cylindrical pour-out with an outer thread in which the screw cap is held.

2. Discussion of Related Art

Screw caps have been known for many years. Their shaping tends to depend on the material from which the receptacle, on which the closure is placed, is manufactured. With glass bottles, the pour-out is usually standardized and the rotary closures must normally correspond to the standard. With receptacles of plastic the pour-out can be more freely varied. Even with receptacles of so-called soft material one applies pour-outs of plastic fastened thereon, which in turn may be manufactured with great freedom with regard to shaping. This invention relates to screw caps which cooperate with receptacles of plastic or soft material, with a pour-out manufactured of plastic and wherein the screw cap and the pour out are matched to one another.

In the present case only screw caps with a guarantee strip which may be opened alone by rotating the screw cap are of interest, wherein simultaneously the guarantee strip is separated from the screw cap. Embodiment forms of such closures are taught by German Patent Reference DE-A-31 11 692, and by European Patent References EP-B-0'149'496, EP-B-0'460'557, EP-B-0'593'396 and EP-B-0'625'950.

The manufacture of such screw caps with a guarantee strip is a problem. On manufacture, the core must be torn out of the screw cap without at the same time the undercuts near the break-off bridge locations leading to the guarantee strips being separated from the screw caps on removal from the mold. The fragile locations are relatively often destroyed during the manufacture and that leads to production interruption and to a rejection of the manufactured closures. In order to reduce a drawback of destruction, there needs to be relatively many break-off locations. Thus, this creates a difficult opening of the screw cap. As known, on screwing open, all break-off locations are uniformly loaded in tension, so that the forces sum and their result is directly related to the number of required break-off locations.

The break-off locations are of course designed extraordinarily thin. The alignment of the molecule chains is thus effected in their region. These molecule chains which are now orientated in the running direction of the break-off webs have their highest resistance force precisely in this running direction. In other words, the forces occurring on screwing open run practically axially to the pour-out direction and thus precisely in the running direction of the break-off locations. Also, it is known that on screwing open, the tension forces are increased relatively slowly, wherein a stretching of material which effects a further alignment of the molecule chains and an increased tear strength.

To reduce the chance of destruction of the guarantee ring or of the guarantee strip on removal from the mold one also applies injection molding tools with sliders. This however leads to extraordinarily expensive tools.

In order to avoid these problems, German Patent Reference DE-A-31 00 629 suggests a screw cap with a guarantee strip with which the guarantee strip is initially integrally formed on the screw cap over the entire wall and the break-off line is only produced retrospectively by way of suitable cutting while leaving the break-off webs. Such closures are considerably easier to open and may be produced with practically no rejects. The manufacture is enormously expensive due to the two-step manufacture. Accordingly, such closures may hardly be obtained in the market.

From the previously discussed closures, it is clear that one may best sever the webs or bridges of the break-off locations between the screw cap and guarantee strip by forces which act in a shearing manner. This principle has only been realized with screw closures on which the guarantee strip is torn away by a tab.

SUMMARY OF THE INVENTION

It is one object of this invention to provide a screw cap of the above mentioned type but which may be screwed on with considerably less force, without having to accept the disadvantages of the known embodiment forms.

This object is achieved by this invention as described in the claims and this specification and in view of the following description with reference to the accompanying drawings.

BRIEF DESCRIPTION OF THE DRAWINGS

One embodiment of this invention is shown in the drawings, wherein.

DESCRIPTION OF PREFERRED EMBODIMENTS

Figure 1:
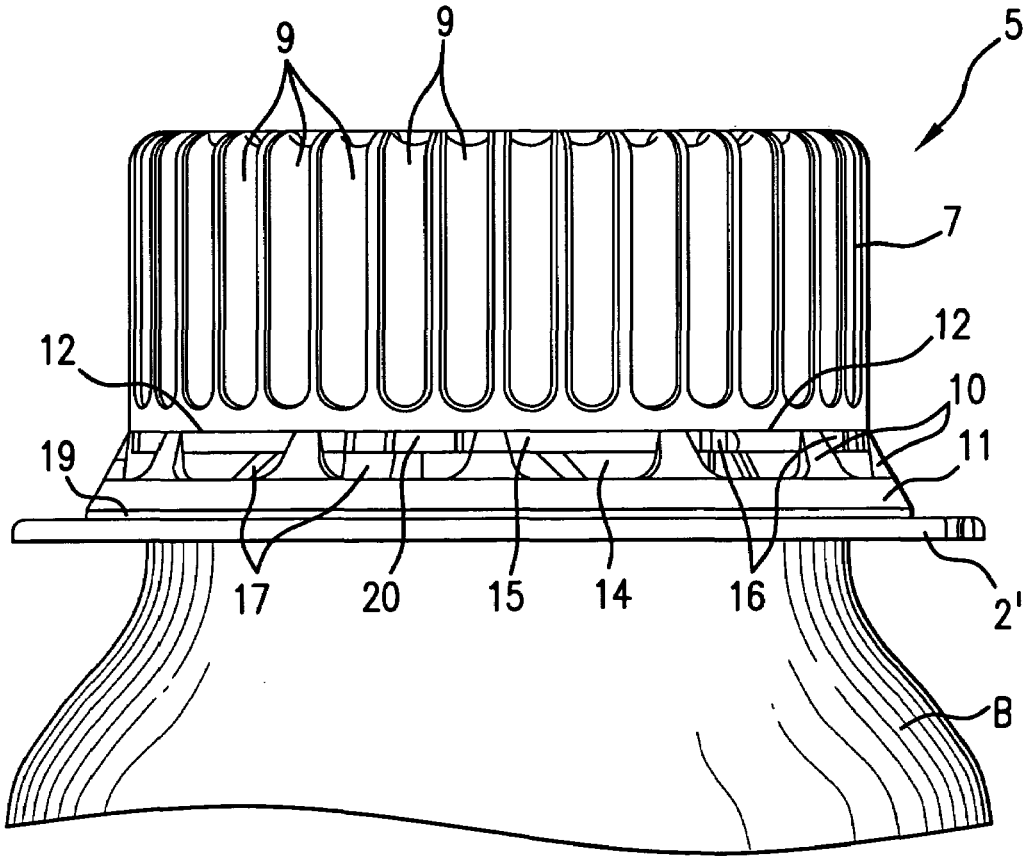
FIG. 1 is a lateral view of the screw cap closure according to this invention, having a pour-out as a separate part with a flange and that may be placed on a receptacle.
Figure 2:
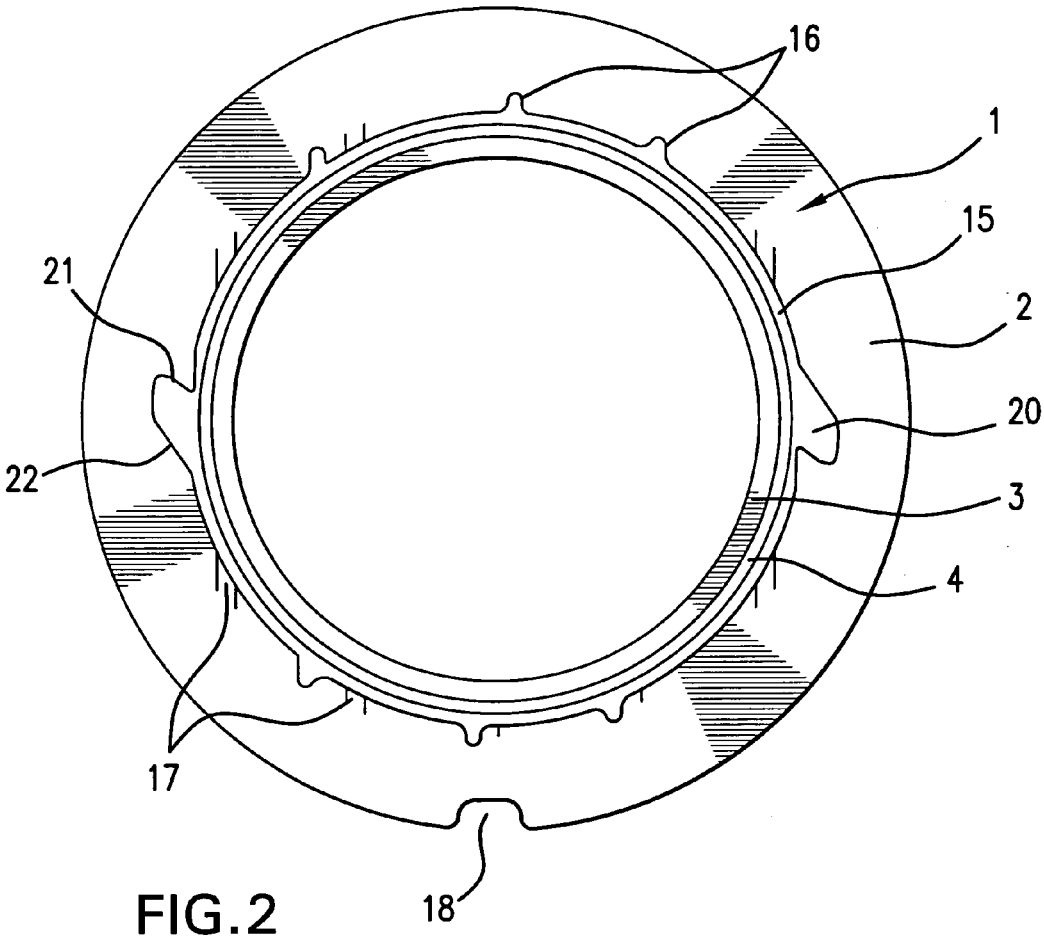
FIG. 2 is a top view of the pour-out that is capable of being placed onto a receptacle.
Figure 3:
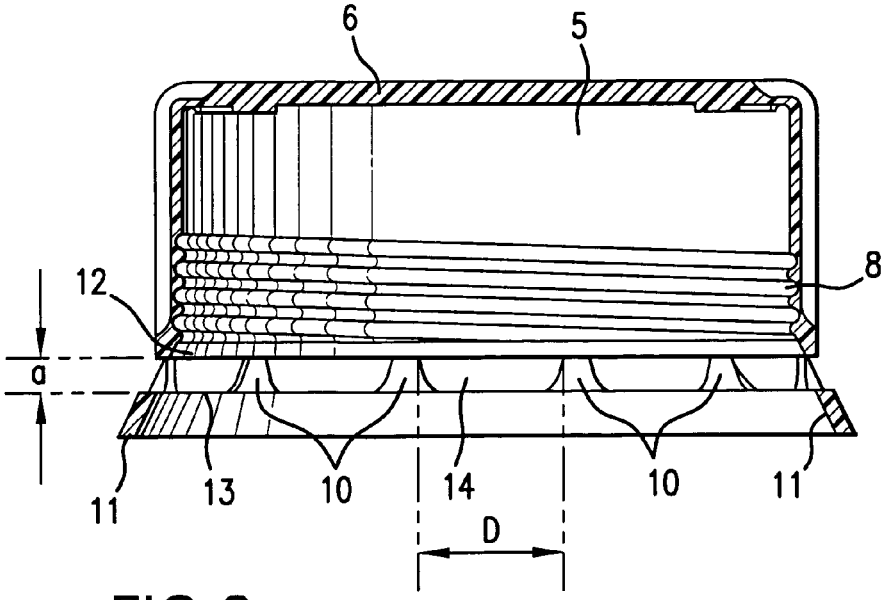
FIG. 3 shows an axial vertical section view taken through the screw cap as shown in FIG. 1, without the pour-out.

FIGS. 1–3 show a screw closure with a pour-out integrally formed or attached on the receptacle, wherein the closure has a screw cap, with an inner thread and with a guarantee strip which is connected to the screw cap via break-off bridge locations and which has no tear-open tab.

The receptacle B, as shown in FIG. 1, may be a plastic bottle or a receptacle of soft material, specifically a flexible bag or tubing which has a multi-layered film of various materials. Such multi-layered, laminated film materials, for example, can be of a paper or cardboard layer which is laminated with several layers with plastic films and an aluminium film ply. The pour-out in the form of a cylindrical bung is adhered or welded on a receptacle of soft material. If the receptacle B is a plastic bottle, then the bung is formed by the bottle neck. The bung 1 has a flange 2 and a cylindrical pour-out 3 which has an outer thread 4. A screw cap 5 may be fastened on the cylindrical pour-out 3 with the outer thread 4. The screw cap 5 has an upper cover surface 6 and at an edge an outer wall 7 connects in a circumferential manner. The outer wall 7 cylindrically formed at least on the inner surface comprises an inner thread 8 on the inner surface. A guarantee strip is integrally formed on the lower edge of the screw cap 5, or on the lower edge of the outer wall 7 via a multitude of break-off bridge locations 10, the guarantee strip 11 has the shape of a conical ring. The break-off bridges 10 bridge the distance a between the lower edge 12 of the cap 5 and the upper edge 13 of the guarantee strip 11. Thus in each case between two adjacent break-off bridge locations 10 and the two mentioned edges there remain intermediate spaces 14.

In order to improve the grip of the screw cap 5, the outer wall 7 comprises a suitable corrugation or knurling 9.

The design of the bung 1 or of the bottle neck is explained with reference to FIG. 2. In FIG. 1 the screw cap 5 is shown unambiguously fastened on a receptacle in the form of a plastic bottle, but FIG. 2 shows a bung that may be attached to soft packagings. The bung 1 has a cylindrical pour-out 3 on whose lower edge a circular flange is integrally formed. With a corresponding configuration of a receptacle of plastic, a collar 2' corresponds to the flange 2. Although the flange 2 is serves mainly for fastening the bung 1 on the soft packaging, the collar 2' in particular is to ensure that one may not manipulate the guarantee strip by griping below the guarantee strip. In the correctly assembled condition the guarantee strip 11, in the case of a plastic receptacle, lies at least approximately on the collar 2' but with the version of a soft packaging the guarantee strip 11 lies on the flange 2. Above the flange 2 on the cylindrical pour-out 3 there is integrally formed a retaining collar 15. The diameter of the retaining collar 15 corresponds approximately to the inner diameter of the screw cap 5 in the region of the lower edge 12. At least one cutting element 20 is integrally formed on the retaining collar 15. The retaining collar 15 has support cams 16 which engage into the mentioned intermediate spaces 14. The cutting elements 20 protrude radially outwards through the intermediate spaces 14. The cutting elements 20 however protrude further outwards than the support cams 16 which project outwards only very slightly and do not contact the break-off bridge locations 10 during the screwing-off movement of the screw cap 5. The support cams 16, as their name indicates, support the screw cap 5 at the correct height during assembly. The screw cap 5 has an inner thread 8 designed as a fine thread just as the outer thread 4 of the cylindrical pour-out 3 which permits the screw cap 5 to be assembled by simply abutting together, wherein the two threads slide over one another in the manner of a ratchet. To ensure that the guarantee strip 11 is not immediately pressed onto the flange 2 or the collar 2' and that the break-off bridge locations are not destroyed on assembly, the support cams 16 may accommodate these forces. The retaining collar 15 itself is in turn connected to the flange 2 or the collar 2' by way of support struts 17. The collar 2' may be supported with respect to the receptacle B. This however is not shown in the drawing. On the flange 2 can be attached an orientation marking 18 which serves for positioning the bung 1 on assembly. The orientation marking permits an alignment of the bung 1 with suitable machines, where the screw cap 5 can have orientation means not shown here, and can then be joined together in a predefined angular position relative to one another, and then may be assembled by a pure pressing onto one another. Thus with such an assembly the cutting elements get exactly into the intermediate spaces 14.

The configuration of the cutting elements 20 or possibly of the single cutting element 20 can have the shape of a fin or a saw-tooth. The edge 21 lying at the front in the screw-off direction, also called the front edge, runs inclined to the radial direction so that when unscrewing the front edge pulls the break-off bridge locations from the outside towards the center and separates these. The edge 22 at the front in the screwing-on direction, which may also be called the rear edge, runs roughly parallel to the front edge 21. If one does not assemble the screw cap 5 according to this invention as previously described by way of a purely axial abutting together, but by screwing on, then the rear edge 22 acts as a deflector and may elastically outwardly deform the break-off bridge locations without a separation occurring at the same time. The formation of the cutting elements 20 as a fin thus effects the possibility of various assembly methods. So this is possible, the conically outwardly projecting guarantee strip 11 with its lower outwardly projecting edge 19 can project so far outwards that when screwing-on, the fin-like cutting element 20 runs below the guarantee strip.

As mentioned, in the assembled condition, the cutting elements 20 and the support cams 16 bear on the lower edge 12 of the outer wall 7. Optimally, the inner thread 8 and the outer thread 4 may have a gradient which is so small that the lower side of the cutting element 20 only bears on the upper edge 13 of the guarantee strip 11 when all break-off bridge locations 10 have been severed. In the example according to FIGS. 1 to 3, this is equal to a rotation of the screw cap 5 by about 180°. This angle depends on how many cutting elements 20 are present and their distribution on the circumference. The distribution of the break-off bridge locations 10 on the circumference also determines the rotation angle which is required for severing all break-off locations.

Figure 4:
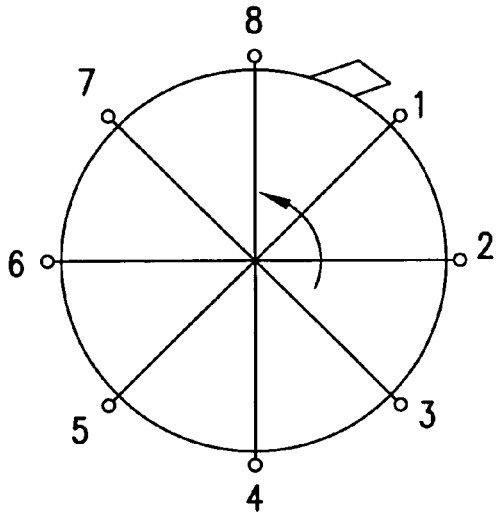
FIGS. 4 to 7 each is a diagrammatic view schematically showing possible arrangements of the cutting elements and the break-off bridge locations.
Figure 5:
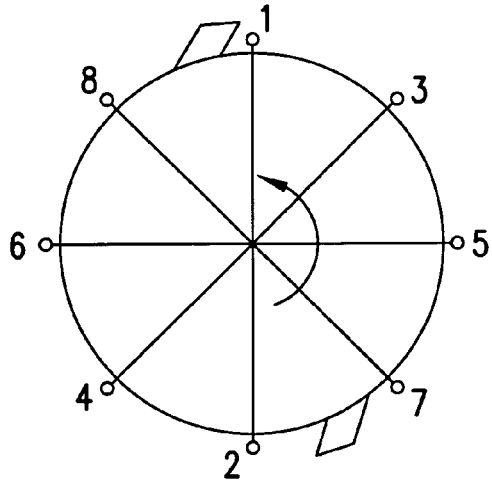

The possibilities of the arrangement for the cutting elements and the break-off bridge locations 10 are now discussed in more detail. With regard to FIG. 4, a single cutting element 20 may be present and the break-off locations are separated after one another in the direction of the rotation of the screw cap, as the indicated numbering explains. In contrast to this embodiment according to FIG. 4, another embodiment is shown in FIG. 5, wherein two cutting elements 20 are present. As shown in FIG. 5 the break-off bridge locations 10 are arranged uniformly distributed on the circumference. The two fin-like cutting elements are not attached exactly diametrically opposite one another but are displaced slightly by an angle. Thus, first the one and thereafter the other cutting element steps into function, and by way of half a rotation all break-off bridge locations are severed. With the displaced arrangement of the cutting elements, for opening this embodiment practically the same force effort is required as with the embodiment according to FIG. 4. It is however quite possible to arrange the cutting elements diametrically opposite one another so that two break-off locations lying diametrically opposite one another are always simultaneously severed. Thus the force effort would practically double.

Figure 6:
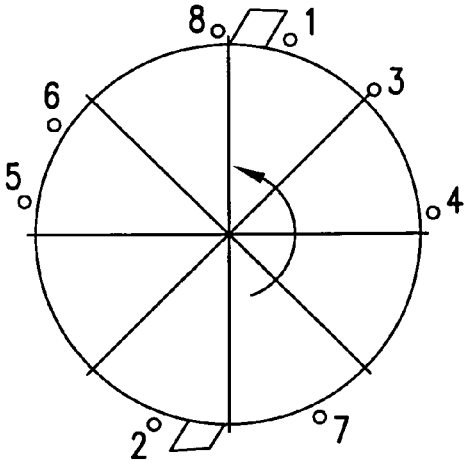

In the embodiment shown in FIG. 6, there are two cutting elements, but in contrast to the embodiment according to FIG. 5 the break-off bridge locations are distributed irregularly on the circumference so that the bridges are severed in the sequence shown.

Figure 7:
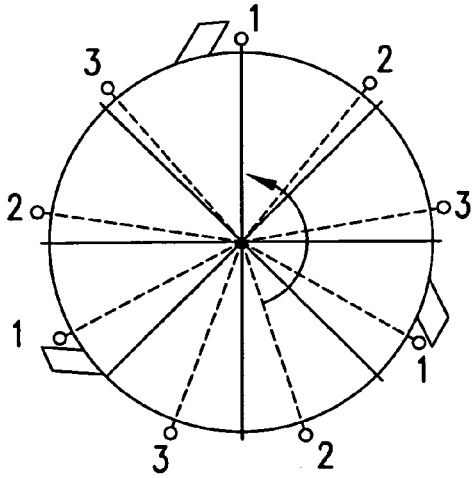

FIG. 7 shows a further embodiment having three cutting elements arranged at uniform distances and between the cutting elements are in each case three break-off bridge locations at uniform distances between two adjacent cutting elements. In this case the closure may be released from the guarantee strip with a third rotation. The force effort with this however is about three times as much as with the embodiment wherein only one bridge is severed simultaneously. Thus it would be possible to arrange the break-off bridge locations irregularly or to integrally form the cutting elements displaced by a small angle, to ensure that only one break-off bridge location is destroyed simultaneously.

The invention claimed is:

1. A receptacle (B) with a closure comprising: a screw cap (5) having an inner thread (8) and a guarantee strip (11)

without a tear-open tab, fastened to the screw cap (5) and connected via break-off bridge locations (10), the receptacle having a cylindrical pour-out (3) with an outer thread (4) on which the screw cap (5) is held, on the pour-out (3) there being integrally formed two cutting elements (20) each of which in a virgin condition of the closure projects at least approximately radially outwards through and between two adjacent break-off bridge locations (10), wherein the two cutting elements are radially displaced from each other by a multiple plus a fraction of a distance (D) between uniformly distributed neighboring break-off bridge locations (10), such that upon rotating the screw cap (5) the two cutting elements consecutively sever the break-off bridge locations (10).

2. A receptacle with a closure according to claim 1, wherein the outer thread and the inner thread (4, 8) are adapted to raise the rotating screw cap (5) more than a distance between a guarantee strip upper edge (13) and a screw cap lower edge (12) after the cutting elements have severed all of the break-off bridge locations (10).

3. A receptacle (B) with a closure according to claim 1, wherein there are more than two of the cutting elements (20) and no more than two of the cutting elements (20) contact the break-off bridge locations (10) simultaneously.

4. A receptacle (B) with a closure according to claim 1, wherein the break-off bridge locations (10) taper from a guarantee strip upper edge (13) towards a screw cap lower edge (12) in a pointed manner.

5. A receptacle (B) with a closure according to claim 1, wherein the cutting elements (20) in an assembled condition, before opening for a first time, at least approximately bear on a lower edge (12) of the screw cap (5).

6. A receptacle (B) with a closure according to claim 1, wherein in addition to the cutting elements (20) further radially outwardly directed support cams (16) are integrally formed on the pour-out (3), which support the screw cap (5) on assembly.

7. A receptacle (B) with a closure according to claim 1, wherein the guarantee strip (11) from the screw cap edge (12) is shaped conically outwards and widens downwards.

8. A receptacle (B) with a closure according to claim 7, wherein a lower outwardly projecting edge (19) of the guarantee strip projects outwards at least equally as far as the cutting elements (20) project outwards in a radial direction.

9. A receptacle (B) with a closure according to claim 1, wherein the cutting elements (20) have a shape of one of a fin and a saw-tooth, with an edge (21) lying at a front in a screwing-off direction and runs inclined to a radial direction so that on screwing off, wherein the edge pulls and severs the break-off bridge locations (10) from an outside towards a center of the screw cap (5) and a second edge (22) which is at the front in the screwing-on direction is inclined to the radial direction so that on screwing on the break-off bridge locations (10) are deformed elastically outwards without effecting a separation.

10. A receptacle (B) with a closure according to claim 1, wherein the screw cap (5) and the pour-out (3) each comprise a positioner (18) which determines a radial alignment of the two parts to one another and permits an assembly by axially abutting together the screw cap (5) and pour-out (3), with which the threads (4, 8) are knocked over one another.

* * * * *